United States Patent [19]

Hansen

[11] Patent Number: 4,960,045

[45] Date of Patent: Oct. 2, 1990

[54] ARRANGEMENT FOR THE COMPRESSING OF REFUSE

[76] Inventor: Henry Hansen, Hajvägen 19, S-432 03, Träslövsläge, Sweden

[21] Appl. No.: 443,050

[22] Filed: Nov. 27, 1989

Related U.S. Application Data

[63] Continuation of Ser. No. 221,784 filed as PCT SE87/00018 on Jan. 19, 1989, published as W087/04409 on Jul. 30, 1987, abandoned.

[30] Foreign Application Priority Data

Jan. 23, 1986 [SE] Sweden ..... 8600296-1

[51] Int. Cl.[5] ..... B30B 15/26; B30B 3/02

[52] U.S. Cl. ..... 100/43; 100/48; 100/65; 100/67; 100/98 R; 100/210

[58] Field of Search ..... 100/43, 48, 65, 67, 100/68, 98 R, 210; 68/102; 56/344, 346; 241/36; 404/121, 124–126; 414/300, 313; 172/177, 554

[56] References Cited

U.S. PATENT DOCUMENTS

| | | | |
|---|---|---|---|
| 1,394,580 | 10/1921 | Rager | 100/67 |
| 2,832,574 | 4/1958 | Hornberger | 241/36 |
| 3,011,430 | 12/1961 | Bloomquist | 100/98 R |
| 3,069,742 | 12/1962 | Walchhuetter | 100/43 X |
| 4,281,945 | 8/1981 | Sinkkonen | 404/121 |
| 4,426,925 | 1/1984 | Bergmann | 100/68 X |
| 4,467,714 | 8/1984 | Bergmann | 100/68 X |
| 4,524,685 | 6/1985 | Bergmann | 100/68 X |
| 4,530,620 | 7/1985 | McCartney | 404/121 |

FOREIGN PATENT DOCUMENTS

| | | | |
|---|---|---|---|
| 258801 | 12/1967 | Austria | 100/65 |
| 1175028 | 7/1964 | Fed. Rep. of Germany | 100/65 |
| 3406879 | 8/1985 | Fed. Rep. of Germany | 100/67 |
| 1181358 | 1/1959 | France | 100/67 |
| 26358 | 10/1963 | German Democratic Rep. | 404/124 |
| 1597948 | 9/1981 | United Kingdom | 100/43 |

*Primary Examiner*—Harvey C. Hornsby
*Assistant Examiner*—Stephen F. Gerrity
*Attorney, Agent, or Firm*—Dvorak and Traub

[57] ABSTRACT

An arrangement for the compressing of refuse and similar materials by means of a number of roller-shaped compressing bodies acting in a container or similar receptacle and moving along the container so as to compress the material. The arrangement permits the effective compressing of the intended material without the need for a major labor input, etc. A number of compressing bodies provided with cutting devices projecting from a core both radially and along its external surface are connected together to form a self-propelled unit, which moves freely inside a container of the kind in question, which unit exhibits driving devices for the free displacement along the container of the aforementioned unit, which unit is capable of being supported by the material to be compressed inside a container of the kind in question, for the purpose both of breaking up and of compressing the material into a compact mass by means of the aforementioned compressing bodies, and in that a connection for transmitting electrical energy and/or drive information, for example, to the unit, is connected to the unit from the outside of the container, and in that the compressing unit is capable of connection to a control panel and is so arranged as to act for a specific period by being controlled via a time relay or actuated manually in order to operate for the desired period or in order to reverse the direction of travel after a certain period has elapsed.

7 Claims, 4 Drawing Sheets

ARRANGEMENT FOR THE COMPRESSING OF REFUSE

RELATED PATENT APPLICATIONS

The present application is a continuation of Ser. No. 221,784 filed as PCT SE87/00018 on Jun. 19, 1987, published as WO87/04409 on Jul. 30, 1987, now abandoned.

BACKGROUND OF THE INVENTION

The present invention relates to an arrangement for the compressing of refuse and similar material by means of a number of roller-shaped compressing bodies acting in a container or similar receptacle and moving along the container so as to compress the material.

SUMMARY OF THE INVENTION

The principal object of the present invention is, in the first place, to make available an arrangement of the kind referred to above which effectively compresses material of varying kinds without the need for a major labour input.

The aforementioned object is achieved by means of an arrangement in accordance with the present invention, the characteristic features of which may be appreciated from the Patent claims.

BRIEF DESCRIPTION OF THE DRAWINGS

The invention is described below as a number of preferred illustrative embodiments, in conjunction with which reference is made to the drawings, in which.

DESCRIPTION OF THE PREFERRED EMBODIMENT

In containers 1 or receptacles of a similar kind, which are open at the top or which are closed and exhibit varying forms, and which are suitable for holding refuse 2 and similar material, an arrangement 3 in accordance with the present invention is intended to be capable of acting in such a way as to break up and compress the material 2 effectively, thus enabling a large quantity of material 2 to be contained therein.

Figure 5:
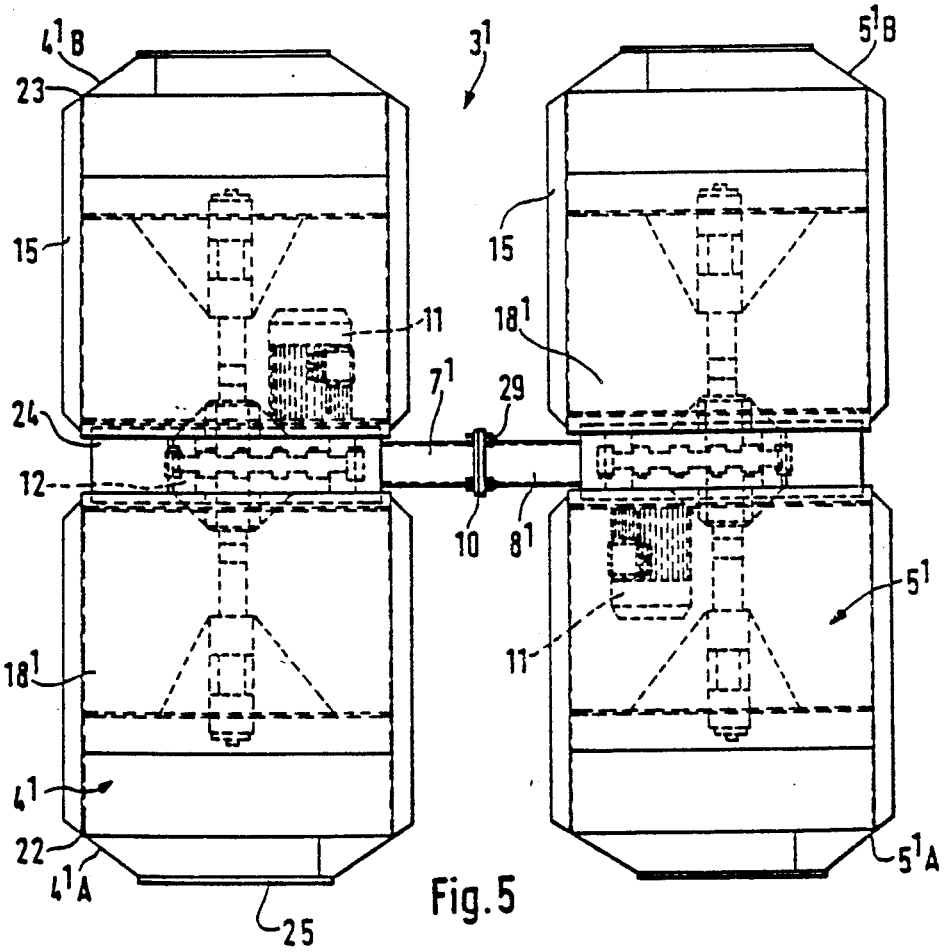
FIG. 5 shows the aforementioned second arrangement viewed from above.
Figure 6:
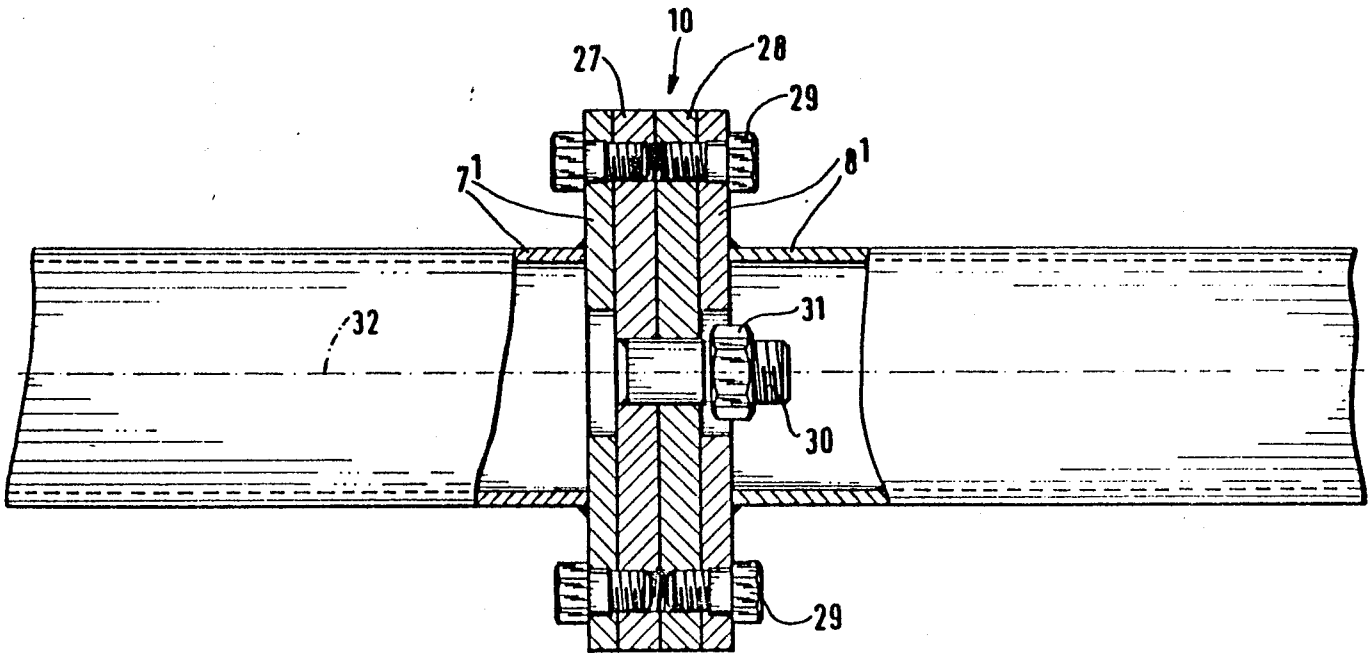
FIG. 6 shows a moving link in cut-away form which can also be applied to an arrangement in accordance with the invention.

The arrangement 3 comprises a number of roller-shaped compressing bodies 4, 5 connected together to form a unit which is so arranged as to be self-propelled and to be freely accommodated inside the container 1 in question and to be controlled from the outside 6 of the container. Two compressing bodies 4, 5 are appropriately connected together via, for example, a connecting tube 7, 8 or some other suitable connecting device extending radially from each compressing body 4, 5, which tubes are connected to one another via a link 9, 10, which can be rigid or fixed, as in the first embodiment illustrated, or which can be moving, as illustrated in FIG. 6, for example. A drive motor 11 with a gearbox 12 attached to it can be enclosed within each compressing body $4^1$, $5^1$, as shown in FIG. 5 in the second embodiment of an arrangement $3^1$. The aforementioned motors 11 can be electrically driven, although the possibility of hydraulic actuation also arises. A connection 13, which can consist of an electric cable mounted on a cable drum, or some other suitable connection for transmitting energy and/or drive information to the unit 3, can be capable of connection to the unit and can be so installed as to be connected to the outside 6 of the container.

Drive information to the unit 3 can be transmitted from a control panel situated at a certain distance from the inside 1A of the container, which control panel can include a control for starting and stopping the arrangement and a control for actuating the time relay for the purpose of setting the desired period for which the arrangement 3 is to operate inside the container 1 or the period after which it shall change direction, depending on the length of the container.

Figure 1:
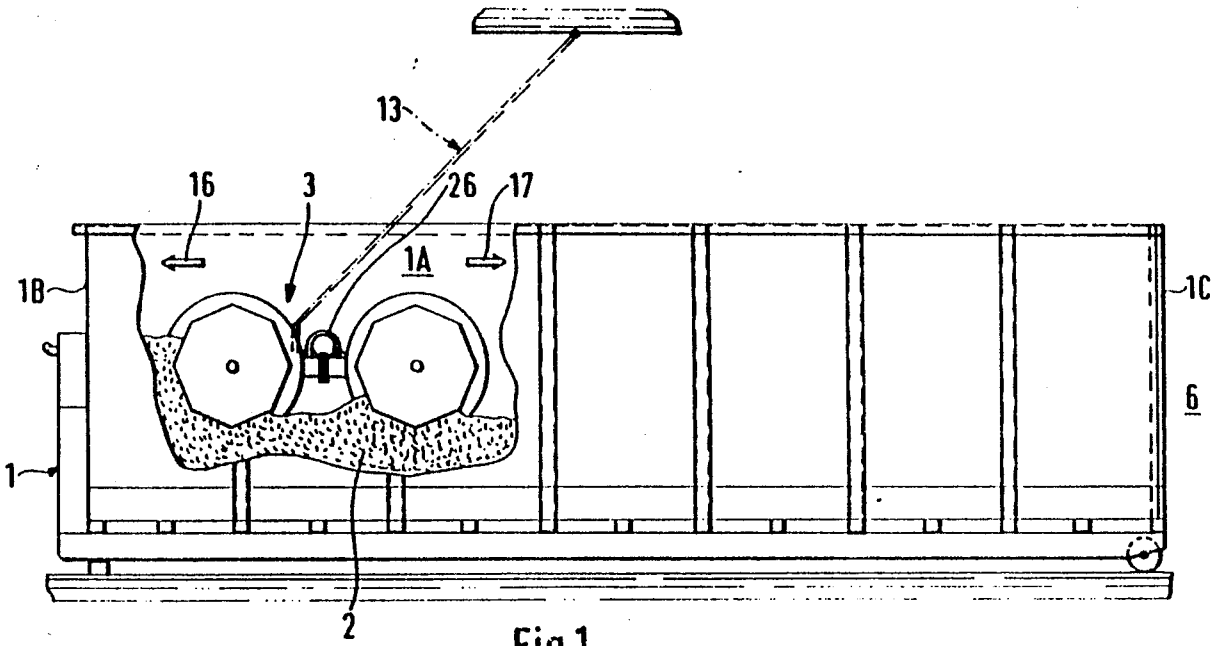
FIG. 1 shows a diagrammatic side view of a compressing device arranged in accordance with the present invention inside a container.
Figure 2:
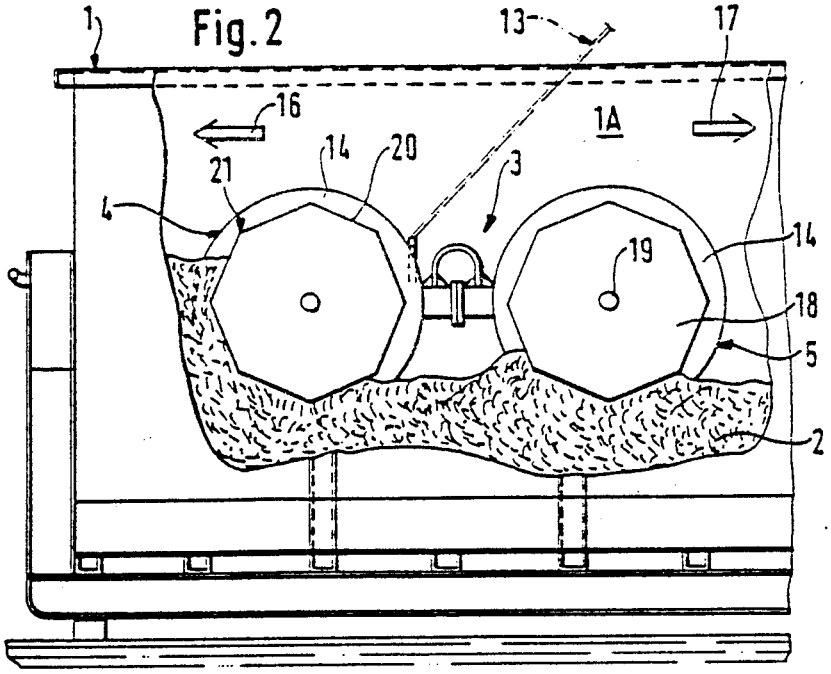
FIG. 2 shows the arrangement in its working position inside a container, viewed from the side in cut-away form.
Figure 3:
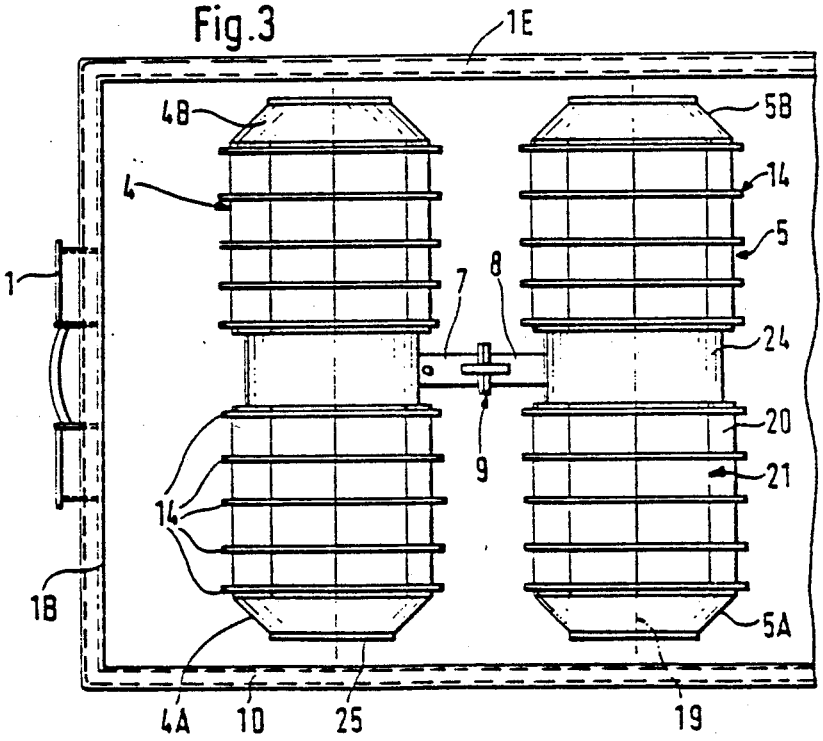
FIG. 3 shows a view of the arrangement from above.

The aforementioned compressing bodies 4, 5 and $4^1$, $5^1$ are provided with devices 14, 15 which are so arranged as to be capable of breaking up material 2, such as household and/or industrial refuse containing paper, wood, plastic and metal, etc., for the period during which the compressing bodies 4, 5; $4^1$, $5^1$ are caused to rotate in the direction 16, 17 in which the arrangement 3; $3^1$ is intended to move inside the container. The aforementioned devices 14 for breaking up the material can consist of several annular knives which are attached to, for example, a preferably polygonal core 18 in the compressing body 4, 5 and are distributed along the axis of rotation 19 of the body, as illustrated in FIG. 3, for example. The knives 14 can exhibit a width such that they extend beyond the boundary edge of the core, measured in the radial sense, or essentially reach as far as the aforementioned boundary edge of the core 18.

The aforementioned polygonal core 18, which in the illustrated embodiment exhibits eight lateral edges 20, but which can exhibit four, six or more lateral edges, is so arranged as to compact the material 2 which has been broken up by the knives 14, at the same time as the arrangement is caused to move inside the container 1 between the boundary walls 1B, 1C of the container by the rotation of the compressing bodies 4, 5; $4^1$, $5^1$. The aforementioned lateral edges 20 of the body and the edges 21 which are situated between the edges and extend across the direction of travel press the material 2 into a compressed, compact mass, which exhibits high density, and constitute the equivalent of running wheels for the arrangement as the arrangement 3 is caused by its own power to move freely inside the container 1 between the aforementioned walls 1B, 1C.

Figure 4:
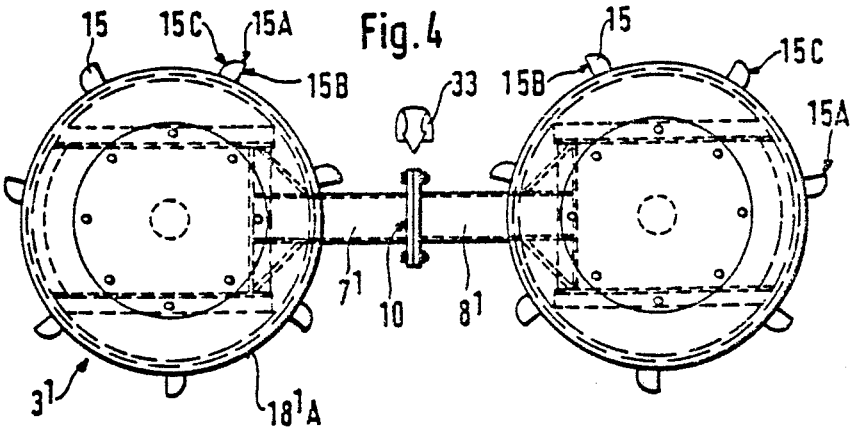
FIG. 4 shows a side view of an arrangement in accordance with a second embodiment.

The core $18^1$ can also exhibit cylindrical form, as shown in FIGS. 4 and 5, in which case consideration may be given to the possibility either of providing helical cutting devices 15 extending, for example, radially outwards from the core along its external surface $18^1$A, in addition to the knives of the kind described above, or of providing such cutting devices 15 on their own. The aforementioned cutting devices 15 can be strip-shaped and can be so arranged as to extend between the ends 22, 23 and the central part 24 of the compressing body, and can be attached by welding, for example. The form of these cutting devices 15 may vary, although their function at all times remains to cut off portions from the intended material 2 and to grind this down, and then to compress the material into a compact mass. For this purpose the cutting devices 15 can exhibit a cutting edge 15A on at least one of their lateral edge surfaces 15B, 15C.

The compressing bodies 4, 5; 4¹, 5¹ can be provided at each of their ends 4A, 4B, 5A, 5B; 4¹A, 4¹B, 5¹A, 5¹B with suitable, easily replaced guards 25, for example a shock-absorbing disc consisting of a flexible material, which are so arranged as to be capable of interacting with each of the side walls 1D, 1E of the container when the unit 1 approaches too close to these and when the bodies arrive at the walls 1D, 1E. Thanks to the compressibility of the guards 25, impacts are absorbed effectively by them.

In order to ensure that the arrangement 3; 3¹ remains within the walls of the container, including when the container 1 begins to be filled with compressed material 2 and is supported by said material 2, means for sensing the position of the arrangement can be provided, for example in the form of a safety system controlled by an IR photo-cell and a logic relay system.

The funtion of the arrangement 3 should have become apparent from the above description, although it can be mentioned briefly that the unit 3 can be raised by means of a hoist, for example, after having been attached to the lifting hook via an eye 26 on the unit 3, and can be lowered into a container with the bodies 4, 5 held in the position illustrated in FIG. 3. As material 2 is filled into the container, the arrangement 3 is caused to move forwards and backwards inside the container 1, in conjunction with which, at the same time as it breaks up the material 2 and compresses it, it also packs down the material so as to permit the effective filling of the container to its maximum level. The appropriate kind of compressing bodies 4, 5; 41, 51 and devices 14, 15 for breaking up the material can be fitted, depending on the composition of the material. The unit 3 is stopped after a pre-set period or by manual actuation of the drive and control devices of the unit when material is no longer being filled into the container, and is subsequently restarted as the need arises. The time relay control system, which can be adjusted according to the length of the container, determines the running time of the unit in each direction 16, 17 before the unit 3 is automatically caused to change its direction of travel so as to move in the opposite direction. When the unit reaches the top of the container and is preferably halted in said position by means of the aforementioned safety system, the unit 3 can be lifted down from the container 1 for use in an unfilled container.

The moving link 10, as shown in FIG. 6, amongst others, consists of discs 27, 28 accommodated between two body arms 7¹, 8¹, which discs are secured by means of bolts 29 to the respective body arms 7¹, 8¹ and are connected to one another via a rod 30 and a nut 31 in such a way as to be free to move. This link permits the bodies to rotate relative to one another about the axis 32 of the link in the direction of the arrow 33.

The invention is not restricted to the illustrative embodiments described above and shown in the drawings, but may be varied within the scope of the Patent Claims without departing from the idea of invention.

What I claim is:

1. An arrangement for compressing refuse material by means of roller-shaped compressing bodies acting in a refuse container and moving along back and forth in the container so as to compress the material, comprising a pair of compressing bodies, each body having a pair of adjoining core members rotatably mounted on a central member, a gear box disposed inside said central member, a motor mounted in one of said core members and connected to said gear box, a drive means interconnecting between said gear box and said core members for rotating said core members, cutting means secured to peripheral surfaces of said core members, a connecting tube extending transversely from each central member, means for coupling free ends of said connecting tubes to provide a tandem cooperative compressing unit, electric control means located exteriorly of the refuse container, a cable connecting said electric control means to the motors in said unit for providing energy and information to operate the unit for a free movement for a predetermined period and to reverse a drive direction after a further predetermined period has elapsed.

2. An arrangement according to claim 1, wherein the cutting means consist of annular knives which are distributed along an axis of rotation of the compressing bodies.

3. An arrangement according to claim 1, wherein the cutting means consist of helical, strip-shaped cutters extending between ends of the compressing bodies.

4. An arrangement according to claim 1, wherein the core members have polygonal shapes, with lateral edges extending transversely across widths of the compressing bodies.

5. An arrangement according to claim 1, wherein the compressing bodies are provided with end guards for protecting the unit from damage upon hitting the interior of the refuse container.

6. An arrangement according to claim 5, wherein the guards are in the form of flexible, shock-absorbing discs.

7. An arrangement according to claim 1, wherein the control means includes an IR photo-cell and a logic relay system to sense the position of the unit in the refuse container to ensure that the unit remains stationary inside the container during predetermined time periods.

* * * * *